US006347953B1

(12) United States Patent
Nogales et al.

(10) Patent No.: US 6,347,953 B1
(45) Date of Patent: Feb. 19, 2002

(54) MODULE CARRIER FOR TWO MODULES

(75) Inventors: Eduard Jorda Nogales, Valls; Gerard Vail Gendre, Reus, both of (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/645,154

(22) Filed: Aug. 24, 2000

Related U.S. Application Data

(63) Continuation of application No. PCT/US99/00657, filed on Jan. 12, 1999.

(30) Foreign Application Priority Data

Feb. 24, 1998 (ES) ..... 9800517

(51) Int. Cl.[7] ..... H01R 13/627
(52) U.S. Cl. ..... 439/354; 439/701
(58) Field of Search ..... 439/701, 353, 439/354, 358

(56) References Cited

U.S. PATENT DOCUMENTS 4,763,224 A 8/1988 Bentz et al.
4,998,889 A * 3/1991 Moly ..... 439/247
5,380,220 A * 1/1995 Okabe ..... 439/456
5,389,006 A * 2/1995 Noschese ..... 439/354
5,663,866 A 9/1997 Ichikawa et al.
5,668,698 A 9/1997 Jozwiak et al.
6,059,612 A * 5/2000 Aoyama ..... 439/701

* cited by examiner

*Primary Examiner*—Neil Abrams
(74) *Attorney, Agent, or Firm*—MacMillan, Sobanski & Todd, LLC

(57) ABSTRACT

A module carrier (10) includes a generally rectangular body portion made up of a plurality of side walls (11, 12) that define a mouth opening (23) through which at least two modules are received into the carrier. Two of the side walls (11) preferably are larger than two other of the side walls (12). The smaller side walls (12) preferably include an inclined surface (16) adjacent the mouth of the carrier and windows (15) near the inclined plane (16). The inclined planes (16) facilitate easier insertion of modules into the carrier and the windows (15) facilitate clicking the modules in place within the carrier. At least one of the major lateral walls (11) includes a pair of wings (20) and a generally U-shaped protection base (22). A catch (18), which includes a projection (19) is positioned between the wings (20) and the protecting base (22) so that undesirable entanglements are not experienced with the module carrier (10).

5 Claims, 1 Drawing Sheet

MODULE CARRIER FOR TWO MODULES

This application is a continuation of PCT/US99/00657, filed Jan. 12, 1999.

BACKGROUND OF THE INVENTION

The present invention generally relates to a module carrier designed to receive two modules including a male terminal and a female terminal.

The technical segment for the present invention is that of the small auxiliary elements for the electrical and electronic wiring and connections in the automotive industry. In modern vehicles it is difficult to set and order the many electric wires and to join and connect them as needed at certain points of an automobile. Additionally, mass production requires the speediest and most efficient way of making such connections with secured connections to avoid failures.

There exists in the market and therefore can be considered the state of the art, a plurality of module carriers that can lodge inside them modules including in themselves the corresponding male and female terminals, having to this goal a series of guiding and retaining elements.

The object of the module carriers is, as is well known, that of giving access to the corresponding modules which, because of their geometric characteristics, must be included in the module carrier in a determined direction and orientation. It is of paramount importance that the interior design of the carrier must allow the introduction of the modules in a quick, reliable way and with no error whatsoever. Further, a carrier must include in its interior a series of male and female terminals, by which the task of inserting the modules into the module carrier must be as direct, quick and with the lightest use of strength possible, since connection and installation operations are fully manual.

SUMMARY OF THE INVENTION

The module carrier of this invention has a generally rectangular body and a mouth for the introduction of the corresponding modules of the lateral insertion type. The introduction of the modules is easier because of an inclined plane provided in the mouth, which allows the reduction of the module insertion force inside the module carrier, all of which being assisted because of an interior arrangement of small walls allowing the separation between the two modules that can be included inside the module carrier.

In two of the lateral walls of the module carrier and in its upper portion are arranged corresponding windows, including an inverted inclined plane, the function of which is that of improving the clicking into place and increasing the retention of the modules included in the interior of the module carrier. The modules preferably include protuberances or jutting points for fitting into the windows.

In at least one of the lateral walls of the module carrier is provided a single external attachment catch ensuring the total clicking into place of the carrier. The external catch is fully protected by a pair of wings and a protecting base, which avoid what otherwise can be wire entanglements and a later break of the catch if and when wires become entangled with the catch provided in the lateral wall.

Other details and characteristics of the present invention will be manifest through the reading of the following description, in which reference is made to the figures attached to this description where the above details are depicted in a rather schematic way. These details are given as an example, referring to a case of a possible practical embodiment, but the invention is not limited to the details outlined. Therefore, this description must be considered from an illustrative point of view and with no limitations whatsoever.

DETAILED DESCRIPTION OF THE PREFERRED EMBODIMENTS

Figure 1:
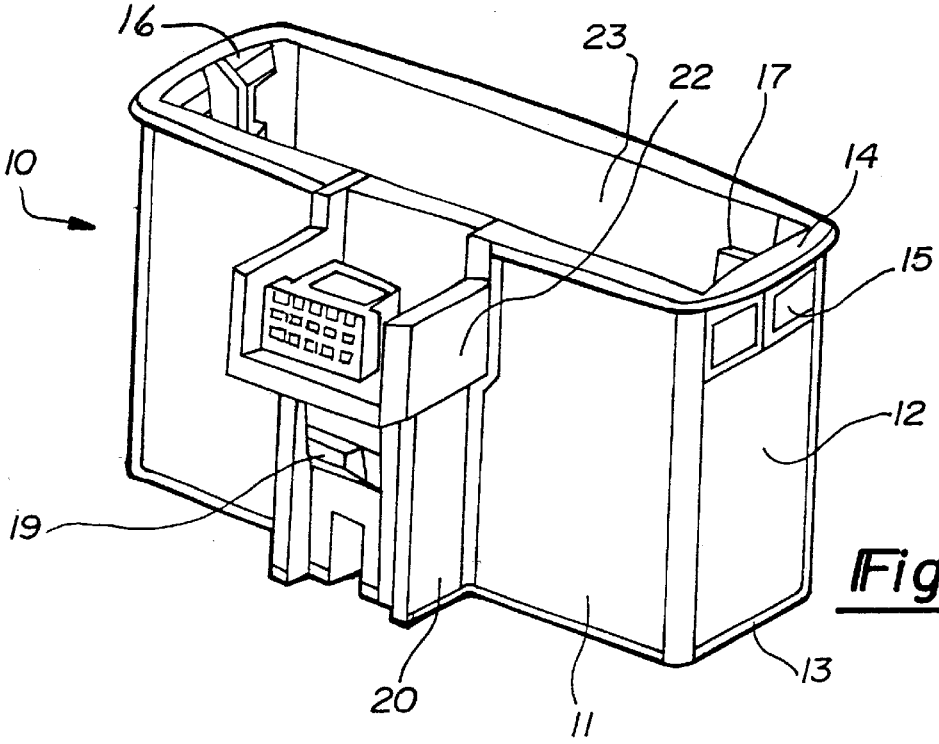
FIG. 1 is a perspective view of an example module carrier of this invention.
Figure 2:
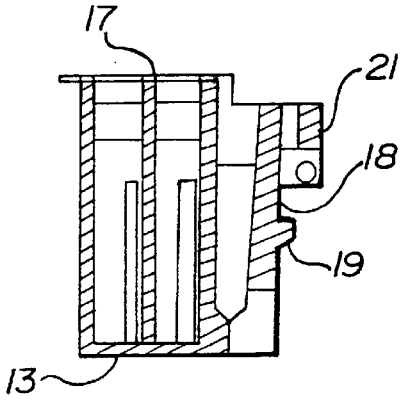
FIG. 2 is a cross-sectional view of the module carrier of FIG. 1.

As can be seen in FIGS. 1 and 2, the module carrier 10 has a body with a generally rectangular configuration with chamfered corners and a upper mouth 23 including a skirt or upper lip 14 directed toward the outside and generally perpendicular to the walls 11 and 12 of the carrier body 10.

The module carrier 10 is formed by major or larger lateral walls 11 and minor or relatively smaller lateral walls 12 emerging perpendicularly from a lower base 13. In the minor lateral walls 12 there preferably are provided generally rectangular windows 15 adjacent the upper lip 14. The function of the windows 15 is to act as retention means to retain modules that are introduced in the carrier 10.

On one of the major lateral walls 11 wings 20 preferably are provided and extend generally perpendicularly to the wall 11. The wings 20 preferably merge in an upper portion into a generally U-shaped protection base 22 protecting a catch 18, which in the upper part is provided with a pressure plane 21 that makes it easier to click into place the corresponding modules (not illustrated) into the carrier 10 through the mouth 23.

Figure 4:
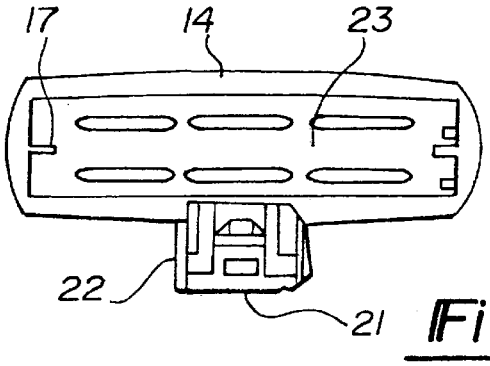
FIG. 4 is a plan view of the top of the module carrier of FIG. 1.

In the interior portion of the module carrier 10 and as can be seen in FIG. 4, arranged in the interior part of the minor lateral walls 12 are certain small walls or ridges 17 extending generally perpendicular and inward from the lateral walls 12, which guide and limit the access of the modules to the interior of the module carrier 10.

Figure 3:
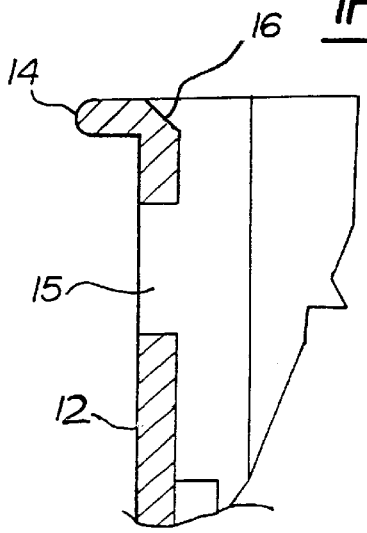
FIG. 3 is an enlarged detail of a partial section of the portion bordering the mouth of the module carrier of FIG. 1.

In order to make easier the access of the module to the interior of the module carrier 10 in the vicinity of the mouth 23 has been designed and an inclined plane 16 in the upper part of the minor lateral walls 12, see FIG. 3, with the object or function or reducing the insertion force of the modules when these are manually introduced into the interior of the module carrier 10.

Complimentary to the above function and in order to accomplish a better retention of the modules introduced inside the module carrier 10, minor lateral walls 12 preferably include windows 15 in the portion of the walls 12 adjacent the opening 23. The windows 15 preferably include an inverse inclined plane for facilitating clicking modules into place and increasing the retention of the modules into the module carrier 10.

In order to ensure the full clicking into place of the module carrier 10 into a corresponding receiving structure (not illustrated) one of the major lateral walls 11 preferably includes a single exterior fixation catch 18 emerging from the lower base 13. The catch 18 preferably includes a projection or spur 19 in its median portion and a pressure plane 21 at a portion that is distal from the base 13.

In order to avoid having wires become entangled with the catch 18, the catch 18 preferably is protected by wings 20 that extend generally perpendicularly to the lateral wall 11. The wings 20 preferably merge into a U-shaped protection base 22 at the portion of the wings 20 most distal from the base 13. A user need only press with their thumb over the pressure plane 21 for clicking or unclicking the carrier 10 into place in order to make easier the access of the modules through the mouth 23 to the interior of the module carrier 10.

The preceding description is exemplary rather than limiting in nature. The scope of legal protection for this invention can only be determined by studying the following claims.

What is claimed is:

1. A module carrier for carrying two electrical connection modules, comprising:

a generally rectangular body having two major lateral walls (11) and two minor lateral walls (12) emerging perpendicularly from a base portion (13) each wall having an end distal from the base (13) combining with the ends of the other walls to form a mouth (23);

one of the major lateral walls (11) including two wings (20) spaced from each other and extending generally perpendicularly away from the major lateral wall, the wings (20) having a first end adjacent the base (13) and a second end at a mid-portion of the lateral wall (11);

a protecting base (22), including two secondary wings spaced from each other, supported by and extending away from the one major lateral wall and away from the second end of the wings, and with a cross member connected between the two secondary wings at about the second end of the wings; and a catch member (18) supported by the base (13) and positioned between the wings (20) and having a portion positioned within the protecting base (22).

2. The module carrier of claim 1, further including a lip portion (14) extending around a perimeter of the mouth and extending away from the distal ends of the lateral walls (11, 12), wherein the terminal ends of the minor lateral walls (12) include inclined planes (16) adjacent the mouth sloping from the lip (14) toward the interior of the module carrier.

3. The module carrier of claim 1, wherein the minor lateral walls (12) each include at least one window (15) positioned near the mouth (23).

4. The module carrier of claim 3, further comprising at least one ridge (17) extending generally inward from each of the minor lateral walls (12) and wherein each minor lateral wall includes two of the windows, one on each side of the ridge.

5. The module carrier of claim 1, wherein the catch includes a projection extending generally away from the catch being adapted to be snapingly received in a corresponding notch on a receiver that is adapted to receive the carrier module.

* * * * *